US007319369B2

(12) United States Patent
Kawanami

(10) Patent No.: US 7,319,369 B2
(45) Date of Patent: Jan. 15, 2008

(54) NON-RECIPROCAL CIRCUIT ELEMENT AND COMMUNICATION DEVICE

(75) Inventor: Takashi Kawanami, Ishikawa-gun (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 11/750,461

(22) Filed: May 18, 2007

(65) Prior Publication Data

US 2007/0216492 A1 Sep. 20, 2007

Related U.S. Application Data

(63) Continuation of application No. PCT/JP2006/321728, filed on Oct. 31, 2006.

(30) Foreign Application Priority Data

Jan. 30, 2006 (JP) ..... 2006-021400

(51) Int. Cl.
*H01P 1/32* (2006.01)

(52) U.S. Cl. ..... 333/1.1; 333/24.2

(58) Field of Classification Search ..... 333/1.1, 333/24.2

See application file for complete search history.

(56) References Cited

U.S. PATENT DOCUMENTS 6,522,216 B2 2/2003 Makino et al.
2002/0033742 A1 3/2002 Makino et al.
2006/0158279 A1 * 7/2006 Kinoshita ..... 333/24.2

FOREIGN PATENT DOCUMENTS

| | | | |
|---|---|---|---|
| JP | 03-206701 | A | 9/1991 |
| JP | 08-070195 | A | 3/1996 |
| JP | 2000-156601 | A | 6/2000 |
| JP | 2002-026615 | A | 1/2002 |
| JP | 2002-198707 | A | 7/2002 |
| JP | 2003-101310 | A | 4/2003 |

OTHER PUBLICATIONS

Official Communication for PCT Application No. PCT/JP2006/321728; mailed Feb. 6, 2007.

* cited by examiner

*Primary Examiner*—Stephen E. Jones
(74) *Attorney, Agent, or Firm*—Keating & Bennett, LLP

(57) ABSTRACT

A non-reciprocal circuit element includes permanent magnets, a ferrite having center electrodes, a circuit substrate on which the permanent magnets and the ferrite are disposed, and an annular yoke. The circuit substrate has substantially rectangular surfaces. The permanent magnets and the ferrite are disposed on a front surface of the circuit substrate. The permanent magnets and the ferrite have principal surfaces that are disposed facing each other and are substantially perpendicular to the front surface of the circuit substrate. The permanent magnets and the ferrite have longitudinal sides that are substantially parallel to longitudinal edges of the circuit substrate.

10 Claims, 8 Drawing Sheets

NON-RECIPROCAL CIRCUIT ELEMENT AND COMMUNICATION DEVICE

BACKGROUND OF THE INVENTION

1. Field of the Invention

The present invention relates to non-reciprocal circuit elements, and particularly, to a non-reciprocal circuit element, such as an isolator and a circulator, for use in microwave bands and to a communication device.

2. Description of the Related Art

Generally, non-reciprocal circuit elements, such as isolators and circulators, have a characteristic that allows a signal to be transmitted only in a predetermined direction but not in the opposite direction. For example, by using this characteristic, isolators can be used in transmitting circuits of mobile communication devices, such as automobile telephones and portable telephones.

Japanese Unexamined Patent Application Publication No. 2002-26615 (Patent Document 1) discloses a non-reciprocal circuit element in which a ferrite assembly, including a ferrite and center electrodes, and permanent magnets are disposed vertically on a rectangular plate-like circuit substrate. The ferrite assembly and the permanent magnets are enclosed by a rectangular box-shaped yoke.

In this non-reciprocal circuit element, however, because the circuit substrate has a rectangular shape with longitudinal sides and lateral sides, the circuit substrate can be easily bent in the longitudinal direction. In addition, since lateral sides of the permanent magnets and the ferrite are disposed along the longitudinal sides of the circuit substrate, the permanent magnets and the ferrite do not function as a beam preventing bending of the circuit substrate in the longitudinal direction. Due to these reasons, the non-reciprocal circuit element is problematic in that if a mount board that has the circuit substrate mounted thereon is bent in the longitudinal direction due to an external force, the circuit substrate may break as a result of not having enough resistance to the bending force. The yoke has a box shape by bending four sides of a single magnetic plate. This is problematic in view of requiring a high cost of manufacture and in that a favorable direct-current magnetic circuit cannot be achieved because of gaps between edges of the four sidewalls of the yoke.

To prevent the circuit substrate from breaking, it is necessary to use a high-strength material for the substrate or to increase the thickness of the substrate. However, the material to be used is limited to a material most appropriate for achieving good electric properties for the substrate, and for this reason, the substrate must actually be designed to have a thickness that provides a required strength. This will lead to an increased height of the non-reciprocal circuit element.

Non-reciprocal circuit elements preferably satisfy the demands of compactness and low-profile structure, have as few variations in electric properties as possible, and have enhanced reliability.

SUMMARY OF THE INVENTION

To overcome the problems described above, preferred embodiments of the present invention provide a highly reliable, low-profile non-reciprocal circuit element in which a circuit substrate thereof is prevented from being damaged as a result of, for example, bending of a mount board, provide a communication device equipped with such an element, provide a non-reciprocal circuit element having low insertion loss and having as few variations in electric properties as possible, and provide a communication device including such a highly reliable, low-profile non-reciprocal element.

A preferred embodiment of the present invention provides a non-reciprocal circuit element which includes a permanent magnet, a ferrite that receives a direct-current magnetic field from the permanent magnet, a plurality of center electrodes disposed on the ferrite, a circuit substrate having terminal electrodes on front and back surfaces thereof, and a yoke that surrounds the permanent magnet and the ferrite on the circuit substrate. The center electrodes in the ferrite are made of conducting layers. The front surface of the circuit substrate is preferably substantially rectangular, and the terminal electrodes include a terminal electrode provided on the front surface and an external-connection terminal electrode provided on the back surface. The permanent magnet and the ferrite are disposed on the front surface of the circuit substrate, the permanent magnet having a principal surface and the ferrite having a principal surface, the principal surfaces being disposed to face each other and set substantially perpendicular relative to the front surface of the circuit substrate, the permanent magnet and the ferrite having longitudinal sides arranged substantially parallel to longitudinal edges of the circuit substrate. A surface of the ferrite that faces the circuit substrate is provided with a connector electrode, the connector electrode being electrically and mechanically connected to the terminal electrode provided on the front surface of the circuit substrate.

With the non-reciprocal circuit element according to preferred embodiments of the present invention, in a state in which the circuit substrate is mounted on a mount board, even when the mount board bends in the lateral direction of the circuit substrate, the circuit substrate is much less likely to be bent because it has sufficient strength in its lateral direction. If the mount board bends in the longitudinal direction of the circuit substrate, the circuit substrate is prevented from breaking since the longitudinal direction of the circuit substrate and the longitudinal direction of the permanent magnet and the ferrite are set substantially parallel to each other. Specifically, the ferrite and the permanent magnet function as beams for reinforcing the circuit substrate in the longitudinal direction.

In the non-reciprocal circuit element according to preferred embodiments of the present invention, the center electrodes preferably include a first center electrode and a second center electrode that are insulated from each other and intersect each other, the first center electrode having one end electrically connected to a first input-output port and the other end electrically connected to a second input-output port, the second center electrode having one end electrically connected to the second input-output port and the other end electrically connected to a third ground port. Accordingly, a two-port lumped-constant isolator having low insertion loss is provided.

Preferably, the yoke has a substantially rectangular annular body that substantially corresponds to an outer peripheral area on the front surface of the circuit substrate, the yoke having longitudinal sidewalls that are disposed substantially parallel to the longitudinal edges of the circuit substrate, the yoke having a joint for connecting the yoke in the annular shape, the joint being located near a lateral edge of the circuit substrate. Because the yoke is connected via a single joint, a favorable direct-current magnetic circuit is achieved. In addition, since there are no joints in the longitudinal sidewalls of the yoke, the longitudinal sidewalls of the yoke function as beams for the circuit substrate, thereby preventing the circuit substrate from breaking. In particular, the joint may be formed by crushing so that a further favorable direct-current magnetic circuit is achieved.

The external-connection terminal electrode provided on the back surface of the circuit substrate may include three or more external-connection terminal electrodes arranged along each of the opposite longitudinal edges of the circuit substrate. In this case, one of the external-connection terminal electrodes is positioned in substantially the central section along each longitudinal edge. This implies that a bending force in the longitudinal direction will have a greater effect on the circuit substrate. However, since the permanent magnet, the ferrite, and the yoke function as beams for reinforcing the circuit substrate in the longitudinal direction, the circuit substrate is effectively prevented from breaking as a result of the bending force.

Furthermore, the joint provided in the yoke is preferably soldered to the terminal electrode of the circuit substrate. In this case, the solder fills a gap formed in the joint so that secure soldering is achieved.

The yoke may be provided with recesses in surfaces of the yoke that face the circuit substrate, the surfaces being adjacent to the longitudinal sidewalls of the yoke. Although the yoke also functions as a ground electrode, undesired stray capacitances generated between capacitor electrodes in the circuit substrate and the yoke are reduced due to the recesses, whereby variations in the electric properties are prevented and minimized. In this case, the longitudinal sidewalls of the yoke can be bonded to the circuit substrate with an adhesive. Consequently, together with the soldered lateral sidewall, this bonding of the longitudinal sidewalls to the circuit substrate prevents the fixation strength from deteriorating. The adhesive used for the bonding is preferably an epoxy-type thermosetting adhesive. Thermosetting adhesives have high thermo-stability, and for this reason, no problems occur when the solder that fixes the lateral sidewall of the yoke in position melts during reflow at the time of the mounting process. This improves the reliability. In addition, the adhesive can be cured simultaneously with the solder by appropriately controlling the conditions, such as temperature and time.

Furthermore, another preferred embodiment of the present invention provides a communication device equipped with the aforementioned non-reciprocal circuit element. Accordingly, the compact and low-profile features of the non-reciprocal circuit element are effectively applied to the communication device. In addition, the non-reciprocal circuit element contributes to fewer variations in the electric properties of the communication device.

According to preferred embodiments of the present invention, a highly reliable non-reciprocal circuit element is provided in which the circuit substrate is reinforced by the permanent magnet, the ferrite, and the yoke so that the circuit substrate is free from breakage and damage. In addition, the reinforcement features give the circuit substrate a required strength even if the substrate is thin, whereby a compact and low-profile structure of the element can be achieved.

Other features, elements, steps, characteristics and advantages of the present invention will become more apparent from the following detailed description of preferred embodiments of the present invention with reference to the attached drawings.

DETAILED DESCRIPTION OF PREFERRED EMBODIMENTS

Preferred embodiments of a non-reciprocal circuit element and a communication device according to the present invention will be described below with reference to the attached drawings.

Figure 1:
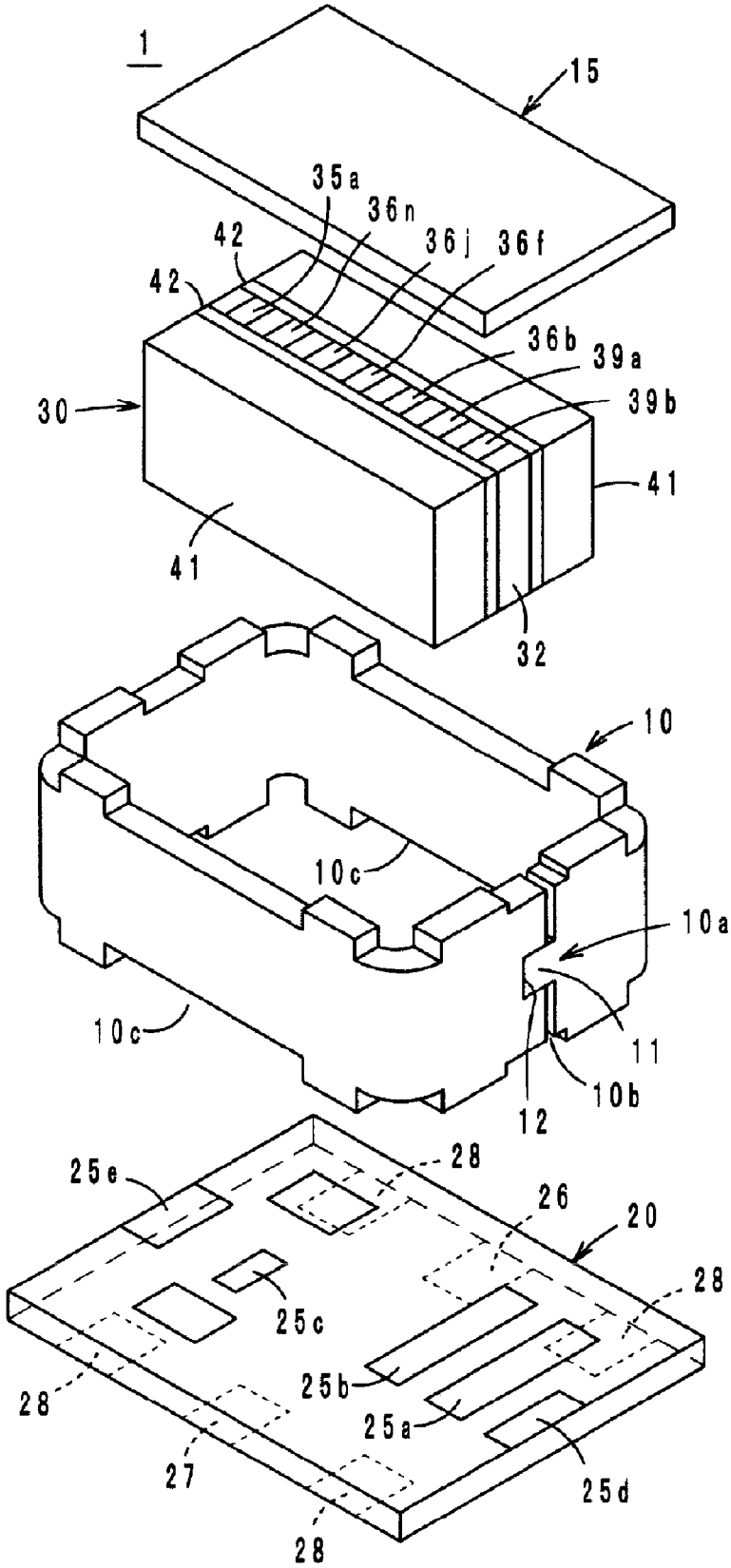
FIG. 1 is an exploded perspective view of a non-reciprocal circuit element (two-port isolator) according to a preferred embodiment of the present invention.

FIG. 1 is an exploded perspective view of a two-port isolator corresponding to a non-reciprocal circuit element according to a preferred embodiment of the invention. A two-port isolator 1 is a lumped-constant isolator that primarily includes a metallic yoke 10, a cap 15, a circuit substrate 20, and a ferrite-magnet assembly 30 defined by a ferrite 32 and permanent magnets 41.

The yoke 10 is preferably composed of a ferromagnetic material, such as soft iron, and is subjected to an anticorrosive treatment. The yoke 10 is a substantially rectangular frame that surrounds all four sides of the ferrite-magnet assembly 30 above the circuit substrate 20. The yoke 10 is preferably formed in the following manner. First, a strip is formed by punching. In this state, a joint 10*a* is not engaged and the yoke 10 is still in its unfolded state. A protrusion 11 and a recess 12 are then tightly engaged with each other by crushing such that an annular body is formed. The joint 10*a* is located at a lateral sidewall of the yoke. A recess 10*c* is provided in a midsection of the lower edge of each longitudinal sidewall of the yoke 10.

Upper surfaces of the ferrite 32 and the permanent magnets 41 have the cap 15 bonded thereto, which is composed of a dielectric material (such as resin and ceramics). The cap 15 may alternatively be made of a soft magnetic metallic plate. The yoke 10 and the cap 15 define a magnetic circuit together with the permanent magnets 41, and are generally plated with silver over a copper-plated foundation layer to enhance the anticorrosive properties and to reduce a conductor loss resulting from an eddy current caused by a high frequency magnetic flux or a conductor loss resulting from a ground current.

Figure 2:
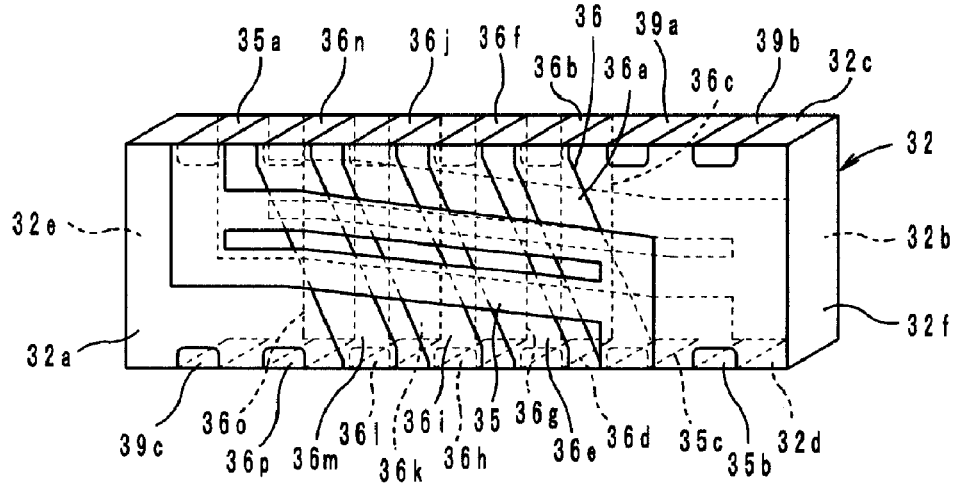
FIG. 2 is a perspective view of a ferrite equipped with center electrodes.

As shown in FIG. 2, the ferrite 32 has first and second principal surfaces 32*a* and 32*b*, which are provided with a first center electrode 35 and a second center electrode 36 that are electrically insulated from each other. The ferrite 32 preferably has a substantially rectangular parallelepiped shape, which has a first principal surface 32*a* and a second principal surface 32*b* that are substantially parallel to each other, and longitudinal side surfaces 32*c*, 32*d* and lateral side surfaces 32*e*, 32*f*.

Figure 4:
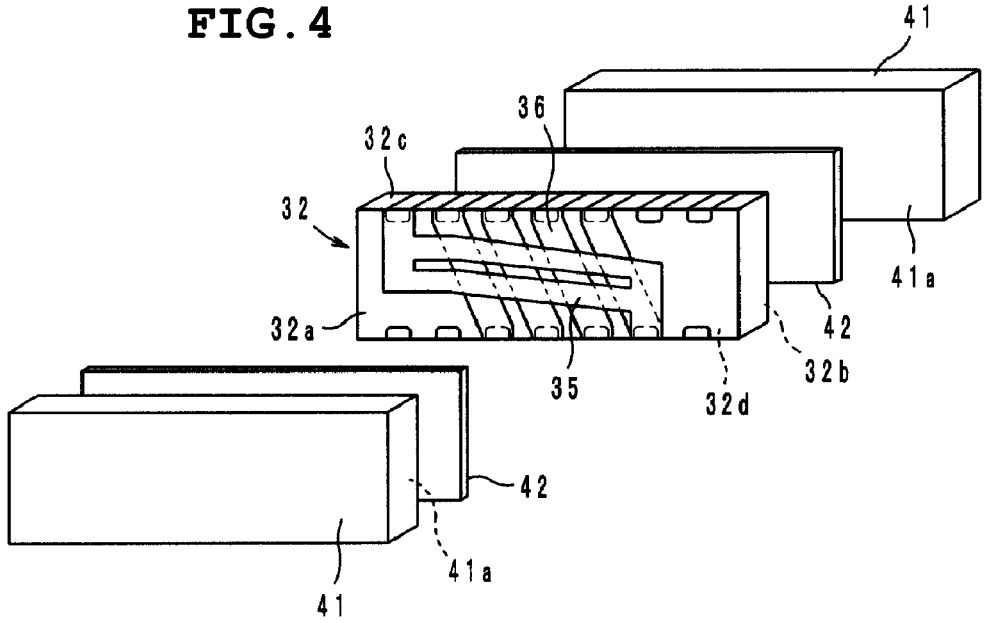
FIG. 4 is an exploded perspective view of a ferrite-magnet assembly.

The permanent magnets 41 are bonded to the respective principal surfaces 32*a*, 32*b* with, for example, epoxy adhesive sheet layers 42 (see FIG. 4) to form the ferrite-magnet assembly 30, such that a magnetic field is applied to the principal surfaces 32*a*, 32*b* of the ferrite 32 in a direction substantially perpendicular to the principal surfaces 32*a*, 32*b*. The permanent magnets 41 have principal surfaces 41*a* that are configured to have substantially the same dimensions as the principal surfaces 32*a*, 32*b* of the ferrite 32. The principal surfaces 32*a* and 41*a* are arranged to face each other such that the outlines thereof are identical with each other, and similarly, the principal surfaces 32*b* and 41*a* are arranged to face each other such that the outlines thereof are identical with each other.

As shown in FIG. 2, the first center electrode 35 extends upward from a lower right section of the first principal surface 32*a* of the ferrite 32 and bifurcates into two segments. The two segments extend in an upper left direction at a relatively small angle with respect to the longitudinal direction. The first center electrode 35 then extends upward to an upper left section and turns toward the second principal surface 32*b* through an intermediate electrode 35*a* on the upper surface 32*c*. On the second principal surface 32*b*, the first center electrode 35 is bifurcated into two segments again so as to overlap with that on the first principal surface 32*a* in perspective view. One end of the first center electrode 35 is connected to a connector electrode 35*b* provided on the lower surface 32*d*. The other end of the first center electrode 35 is connected to a connector electrode 35*c* provided on the lower surface 32*d*. Thus, the first center electrode 35 is wound around the ferrite 32 by one turn. The first center electrode 35 and the second center electrode 36 to be described below have an insulating layer therebetween, such that these electrodes intersect each other in an insulated state.

The second center electrode 36 has a 0.5th-turn segment 36*a* that extends in the upper left direction from a substantially midsection of the lower edge of the first principal surface 32*a* at a relatively large angle with respect to the longitudinal direction and intersects the first center electrode 35. The 0.5th-turn segment 36*a* turns toward the second principal surface 32*b* through an intermediate electrode 36*b* on the upper surface 32*c* so as to connect to a 1st-turn segment 36*c*. On the second principal surface 32*b*, the 1st-turn segment 36*c* intersects the first center electrode 35 in a substantially perpendicular manner. A lower end portion of the 1st-turn segment 36*c* turns toward the first principal surface 32*a* through an intermediate electrode 36*d* on the lower surface 32*d* so as to connect to a 1.5th-turn segment 36*e*. On the first principal surface 32*a*, the 1.5th-turn segment 36*e* extends substantially parallel to the 0.5th-turn segment 36*a* and intersects the first center electrode 35. The 1.5th-turn segment 36*e* turns toward the second principal surface 32*b* through an intermediate electrode 36*f* on the upper surface 32*c*. In a similar manner, a 2nd-turn segment 36*g*, an intermediate electrode 36*h*, a 2.5th-turn segment 36*l*, an intermediate electrode 36*j*, a 3rd-turn segment 36*k*, an intermediate electrode 36*l*, a 3.5th-turn segment 36*m*, an intermediate electrode 36*n*, and a 4th-turn segment 36*o* are provided on the corresponding surfaces of the ferrite 32. The opposite ends of the second center electrode 36 are respectively connected to connector electrodes 35*c* and 36*p* provided on the lower surface 32*d* of the ferrite 32. The connector electrode 35*c* is commonly used between the ends of the first center electrode 35 and the second center electrode 36.

In other words, the second center electrode 36 is helically wound around the ferrite 32 by four turns. The number of turns is calculated based on the fact that one crossing of the center electrode 36 across the first principal surface 32*a* or the second principal surface 32*b* equals a 0.5 turn. The intersecting angle between the center electrodes 35, 36 is set on an as-needed basis so as to adjust the input impedance and insertion loss.

The first and second center electrodes 35, 36 can be modified into various shapes. For example, although the first center electrode 35 in this preferred embodiment is preferably bifurcated into two segments on each of the principal surfaces 32*a*, 32*b* of the ferrite 32, the first center electrode 35 does not necessarily need to be bifurcated.

Figure 3:
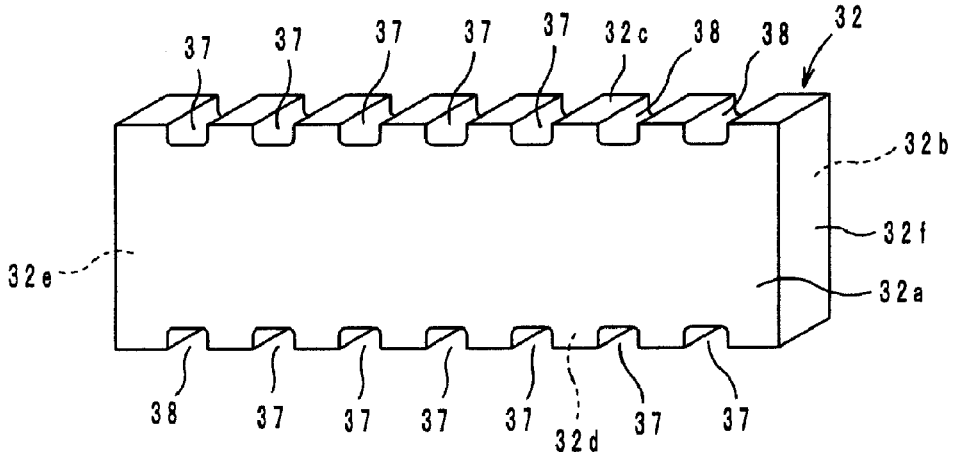
FIG. 3 is a perspective view of the ferrite.

The connector electrodes 35*b*, 35*c*, 36*p* and the intermediate electrodes 35*a*, 36*b*, 36*d*, 36*f*, 36*h*, 36*j*, 36*l*, 36*n* are formed by embedding electrode conductors into corresponding recesses 37 (see FIG. 3) provided on the upper and lower surfaces 32*c*, 32*d* of the ferrite 32. In addition, the upper and lower surfaces 32*c*, 32*d* have dummy recesses 38 provided substantially in parallel to the electrodes, and are also provided with dummy electrodes 39*a*, 39*b*, 39*c*. These electrodes are formed by preliminarily forming through holes in a mother ferrite substrate, embedding electrode conductors into these through holes, and then cutting the substrate along locations at which the through holes are to be cut. Alternatively, these various electrodes may be formed as conducting layers in the recesses 37, 38.

As a ferrite 32, a YIG ferrite is preferably used. The first and second center electrodes 35, 36 and the other various electrodes are each preferably formed as a thick film composed of silver or a silver alloy by, for example, printing, transferring, or photolithography. The insulating layer between the center electrodes 35 and 36 may be a thick glass dielectric film.

Generally, strontium, barium, or lanthanum-cobalt ferrite magnets are preferably used as the permanent magnets 41. In contrast to a metallic magnet defining a conductor, a ferrite magnet is also a dielectric, which implies that a high frequency magnetic flux can be distributed within the magnet without loss. For this reason, even if the permanent magnets 41 are disposed close to the center electrodes 35, 36, deterioration of electrical properties, including an insertion loss, are substantially prevented. Moreover, the temperature characteristics in the saturation magnetization of the ferrite 32 and the temperature characteristics in the magnetic flux density of the permanent magnets 41 are similar. Therefore, with the isolator being defined by a combination of the ferrite 32 and the permanent magnets 41, the temperature-dependent electrical properties of the isolator are satisfactory.

Figure 6:
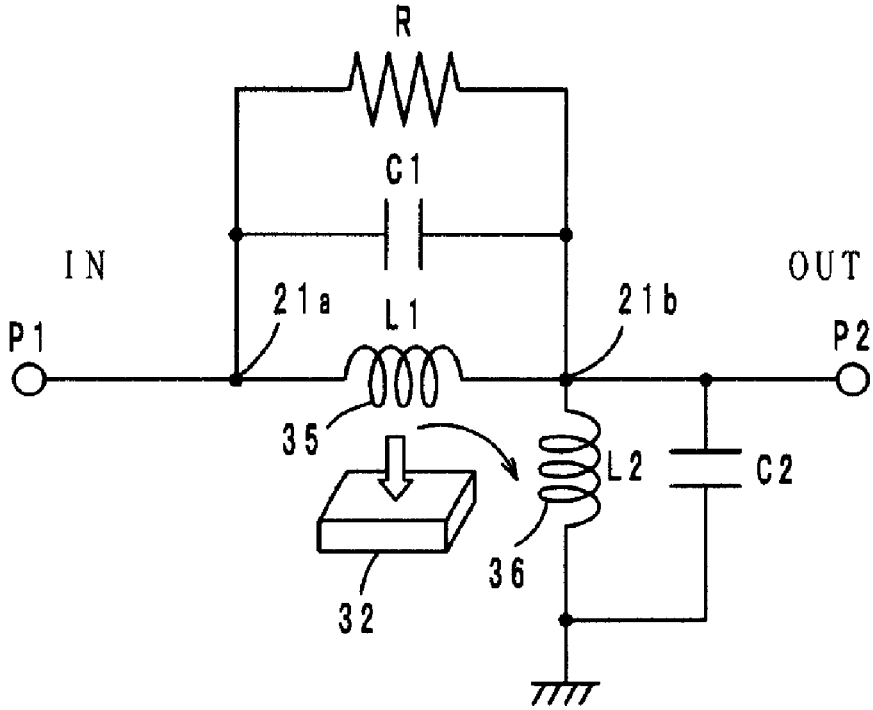
FIG. 6 is an equivalent circuit diagram showing a first circuit example of the two-port isolator.
Figure 7:
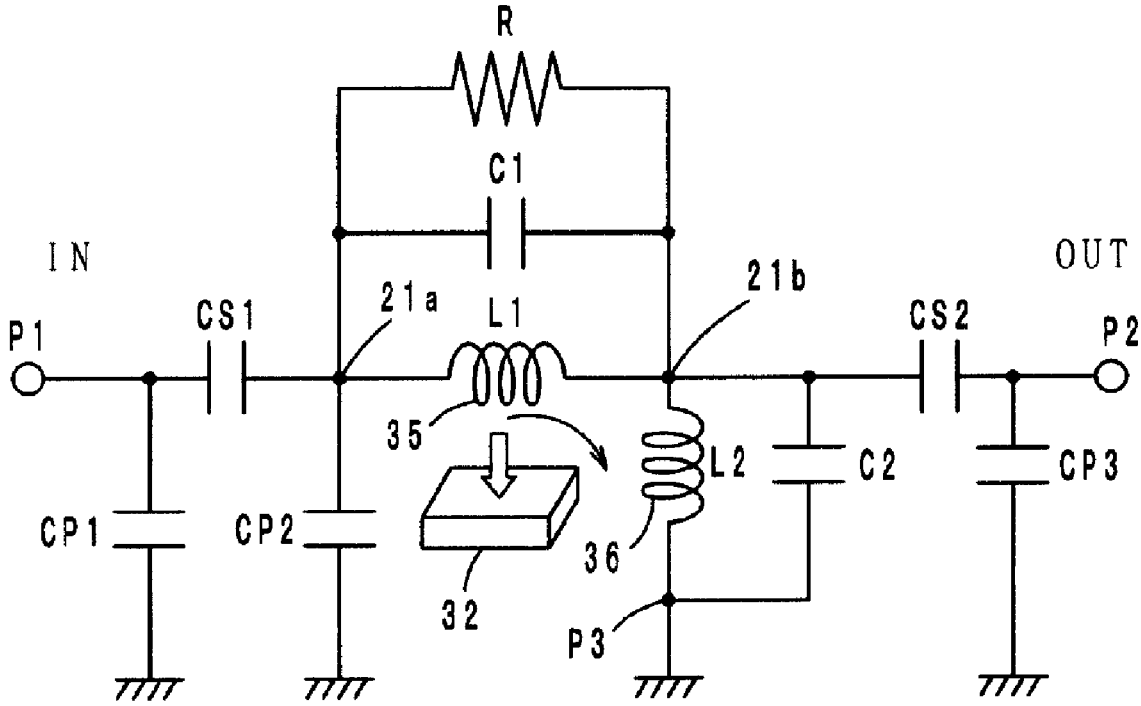
FIG. 7 is an equivalent circuit diagram showing a second circuit example of the two-port isolator.

The circuit substrate 20 is substantially rectangular in plan view, and is a sintered multilayer substrate having predetermined electrodes provided on a plurality of dielectric sheets. As shown in FIGS. 6 and 7, the circuit substrate 20 includes matching capacitors C1, C2, CS1, CS2, CP1, CP2, CP3 and a terminating resistor R. The circuit substrate 20 also includes terminal electrodes 25*a* to 25*e* on the top surface thereof and external-connection terminal electrodes 26, 27, 28 on the bottom surface thereof. Three external-connection terminal electrodes 26, 27, 28 are arranged along each of opposite longitudinal edges of the circuit substrate 20.

Figure 5:
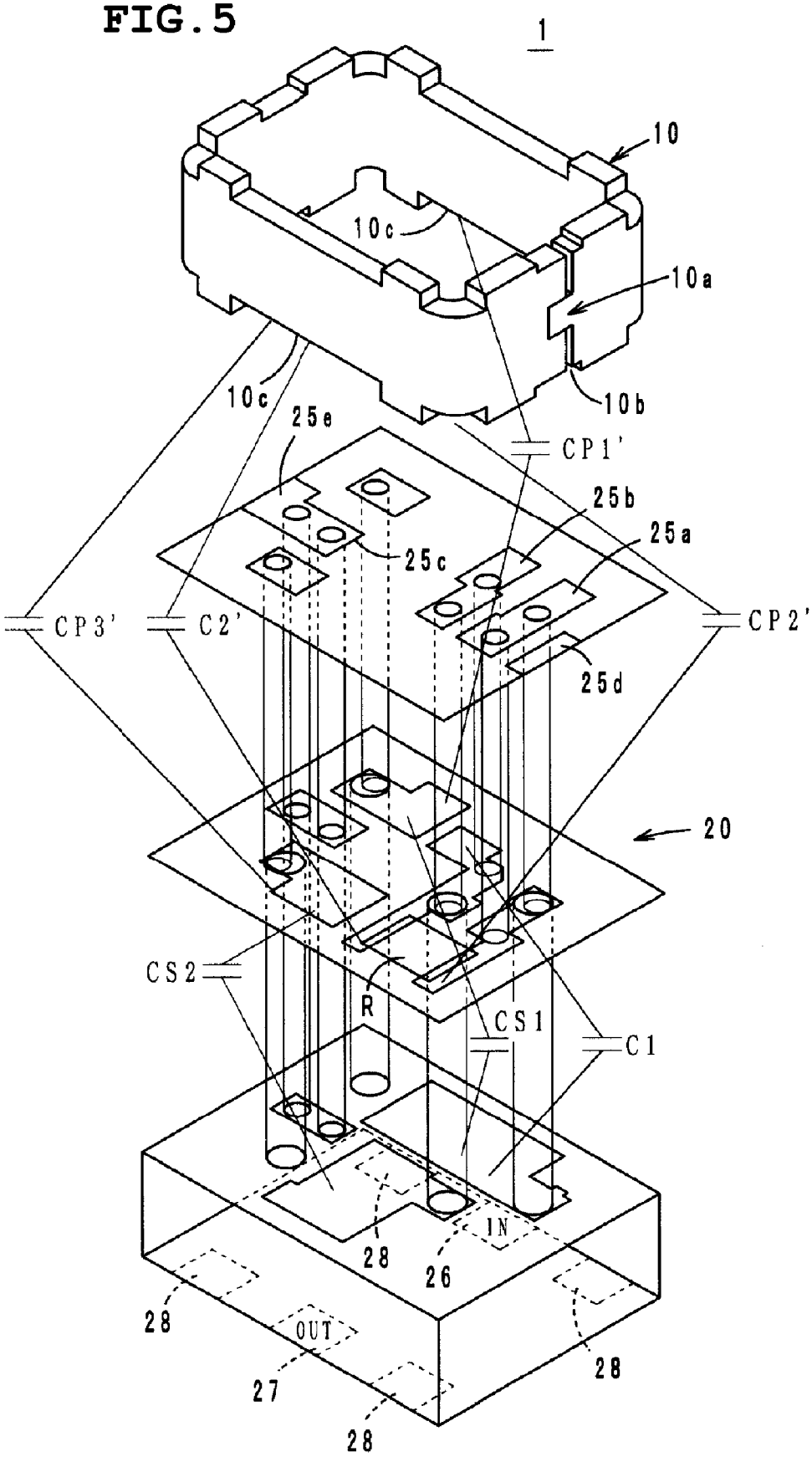
FIG. 5 is a block diagram showing a circuit configuration in a circuit substrate.

The connection relationships among these matching circuit components and the first and second center electrodes 35, 36 will be described with reference to equivalent circuit diagrams shown in FIGS. 6 and 7. The equivalent circuit diagram in FIG. 6 shows a first basic circuit example in the non-reciprocal circuit element (two-port isolator 1) according to a preferred embodiment of the present invention. The equivalent circuit diagram in FIG. 7 shows a second circuit example. FIG. 5 illustrates the electrode configurations in the upper three layers of the circuit substrate 20 according to the second circuit example shown in FIG. 7.

Specifically, the external-connection terminal electrode 26 provided on the bottom surface of the circuit substrate 20 functions as an input port P1. This terminal electrode 26 is connected to a connection point 21*a* between the matching capacitor C1 and the terminating resistor R via the matching capacitor CS1. The connection point 21*a* is connected to the one end of the first center electrode 35 via the terminal electrode 25*a* provided on the top surface of the circuit substrate 20 and the connector electrode 35*b* provided on the lower surface 32*d* of the ferrite 32.

The other end of the first center electrode 35 and the one end of the second center electrode 36 are connected to the terminating resistor R and the matching capacitors C1, C2 via the connector electrode 35*c* provided on the lower surface 32*d* of the ferrite 32 and the terminal electrode 25*b* provided on the top surface of the circuit substrate 20.

On the other hand, the external-connection terminal electrode 27 provided on the bottom surface of the circuit substrate 20 functions as an output port P2. This terminal electrode 27 is connected to a connection point 21*b* between the matching capacitors C2, C1 and the terminating resistor R via the matching capacitor CS2.

The other end of the second center electrode 36 is connected to the matching capacitor C2 and to the external-connection terminal electrodes 28 provided on the bottom surface of the circuit substrate 20 via the connector electrode 36*p* provided on the lower surface 32*d* of the ferrite 32 and the terminal electrode 25*c* provided on the top surface of the circuit substrate 20. The external-connection terminal electrodes 28 function as a ground port P3. Furthermore, the external-connection terminal electrodes 28 are also connected to the yoke 10 via the terminal electrodes 25*d*, 25*e* provided on the top surface of the circuit substrate 20.

A connection point between the input port P1 and the capacitor CS1 is connected to an impedance-adjusting capacitor CP1 that is connected to ground. The connection point 21*a* between the matching capacitor CS1 and the one end of the first center electrode 35 is connected to an impedance-adjusting capacitor CP2 that is connected to ground. Likewise, a connection point between the output port P2 and the capacitor CS2 is connected to an impedance-adjusting capacitor CP3 that is connected to ground.

Figure 8:
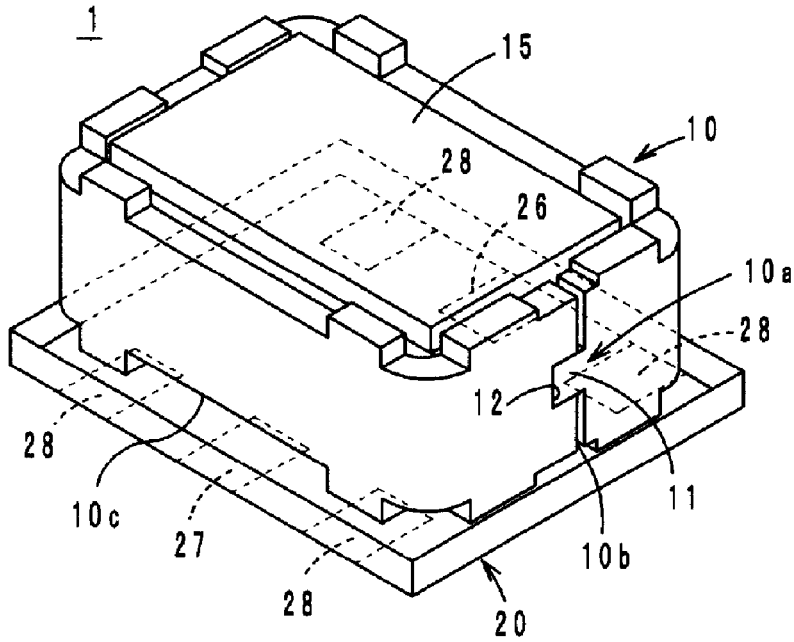
FIG. 8 is a perspective view showing a bonded state of the circuit substrate and a yoke.

The circuit substrate 20 and the yoke 10 are combined with each other by soldering them together through the terminal electrodes 25*d*, 25*e* and other dummy electrodes. More specifically, referring to FIG. 8, the yoke 10 includes longitudinal sidewalls that are aligned with the longitudinal edges of the circuit substrate 20 and is bonded to the circuit substrate 20 such that the joint 10*a* is located at one of the lateral sidewalls of the yoke 10. The soldering is implemented at the joint 10*a*, and the solder fills a gap 10*b* so that tight and secure bonding is achieved. The gap 10*b* is provided as a clearance space for a bulge that is formed when engaging the protrusion 11 with the recess 12 by crushing. The lower surfaces of the longitudinal sidewalls of the yoke 10 are bonded to the circuit substrate 20 by filling the recesses 10*c* with an adhesive. As an adhesive, an epoxy-type thermosetting adhesive may preferably be used.

The ferrite-magnet assembly 30 is arranged such that the principal surfaces 32*a*, 32*b*, 41*a* thereof are substantially perpendicular to the front surface of the circuit substrate 20 and such that the longitudinal sides of the ferrite 32 and the permanent magnets 41 are arranged substantially parallel to the longitudinal edges of the circuit substrate 20. More specifically, the electrodes on the lower surface 32*d* of the ferrite 32 in the ferrite-magnet assembly 30 are bonded to the terminal electrodes 25*a*, 25*b*, 25*c* and other dummy terminal electrodes on the circuit substrate 20 by soldering, and the lower surfaces of the permanent magnets 41 are bonded on the circuit substrate 20 with an adhesive. A one-part or two-part thermosetting epoxy adhesive is suitable for this adhesive. In other words, using both solder and adhesive for the bonding between the ferrite-magnet assembly 30 and the circuit substrate 20 ensures a secure connection.

The circuit substrate 20 may be a substrate formed by firing a mixture of glass and alumina or other dielectric materials or may be a composite substrate composed of resin or glass and other dielectric materials. The internal and external electrodes may each be formed of, for example, a thick film composed of silver or a silver alloy, a thick film composed of copper, or a copper foil. In particular, the external-connection terminal electrodes are preferably plated with gold over a nickel-plated layer. This is to enhance the anticorrosive properties and the resistance to solder leaching, and to prevent the strength of the soldered sections from being reduced due to various causes.

In the two-port isolator 1 described above, one end of the first center electrode 35 is connected to the input port P1 and the other end thereof is connected to the output port P2, and one end of the second center electrode 36 is connected to the output port P2 and the other end thereof is connected to the ground port P3. Consequently, a two-port lumped-constant isolator with a low insertion loss is provided. Moreover, when the isolator is in operation, a large magnitude of high frequency current flows into the second center electrode 36, whereas very little high frequency current flows into the first center electrode 35. Accordingly, the direction of the high frequency magnetic field produced by the first center electrode 35 and the second center electrode 36 is determined based on the position of the second center electrode 36. The determination of the direction of high frequency magnetic field facilitates a further reduction of the insertion loss.

Figure 9:
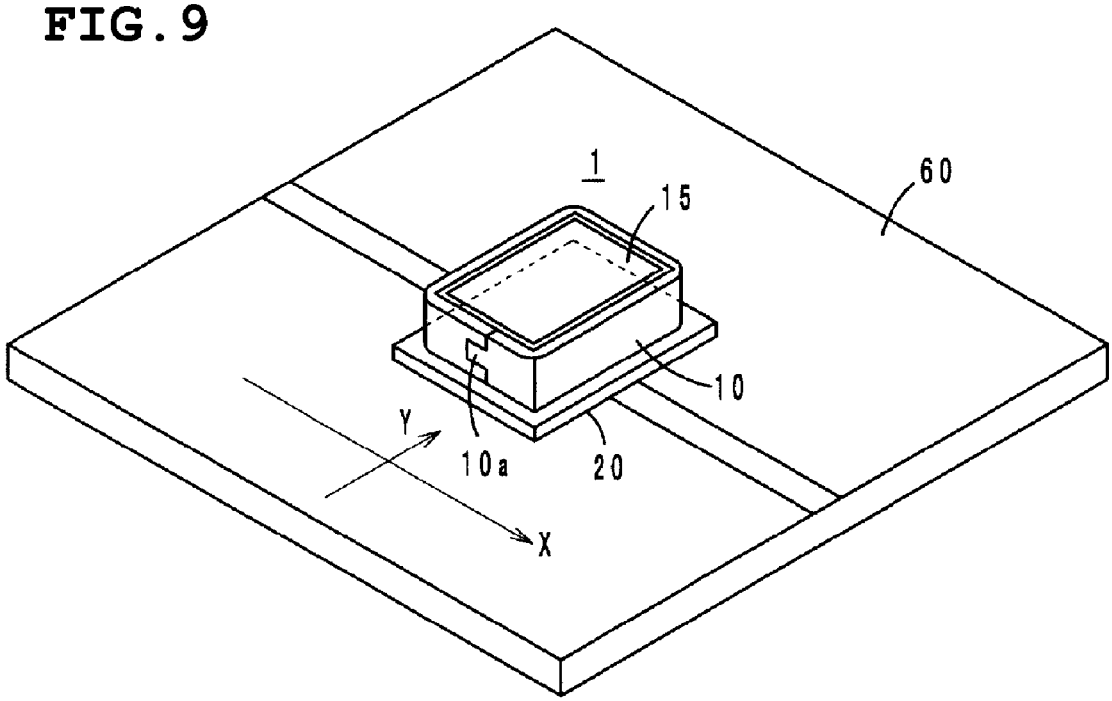
FIG. 9 is a perspective view showing a state where the non-reciprocal circuit element is mounted on a mount board.

Breaking of the circuit substrate 20 will now be discussed. The isolator 1 is mounted on a mount board 60 (see FIG. 9) by soldering the external-connection terminal electrodes 26, 27, 28 of the circuit board 20 to lands, not shown, provided on the mount board 60. In this case, when the mount board 60 bends in the direction of an arrow X, which is parallel to the lateral direction of the circuit substrate 20, or bends in the direction of an arrow Y, which is parallel to the longitudinal direction, in response to an external force, a bending force acts on the circuit substrate 20.

Figure 10:
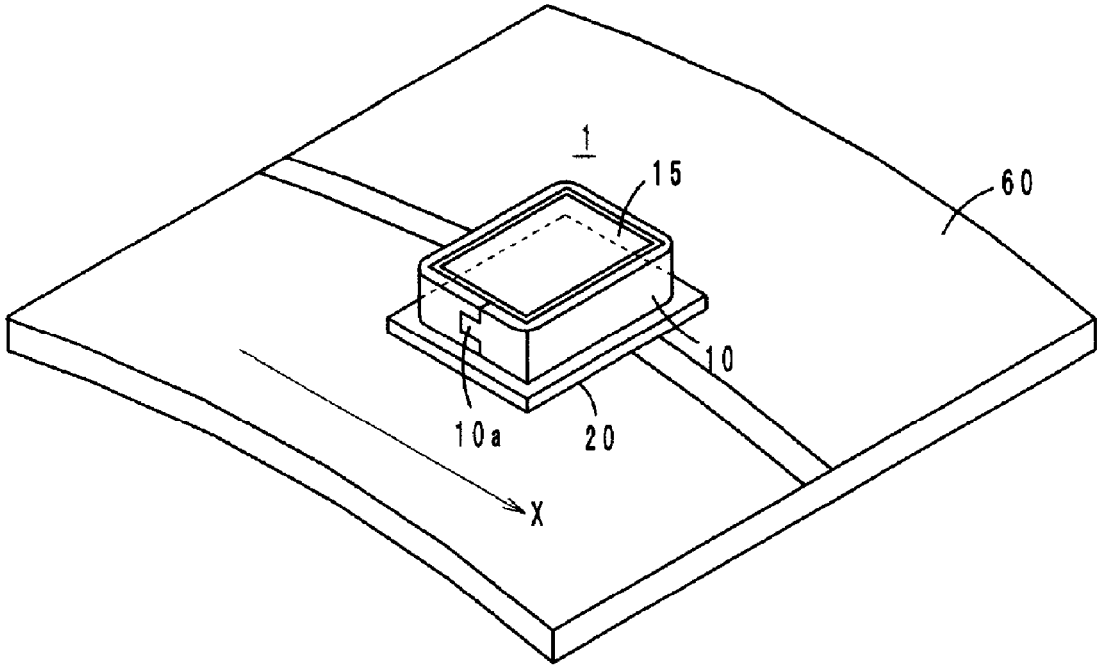
FIG. 10 is a perspective view showing a state where the mount board has warped in a lateral direction.

As shown in FIG. 10, in a state in which the circuit substrate 20 is mounted on the mount board 60, when the mount board 60 bends in the X direction, the circuit substrate 20 is less likely to break since it has a short span in the lateral direction X and thus has sufficient strength.

Figure 11:
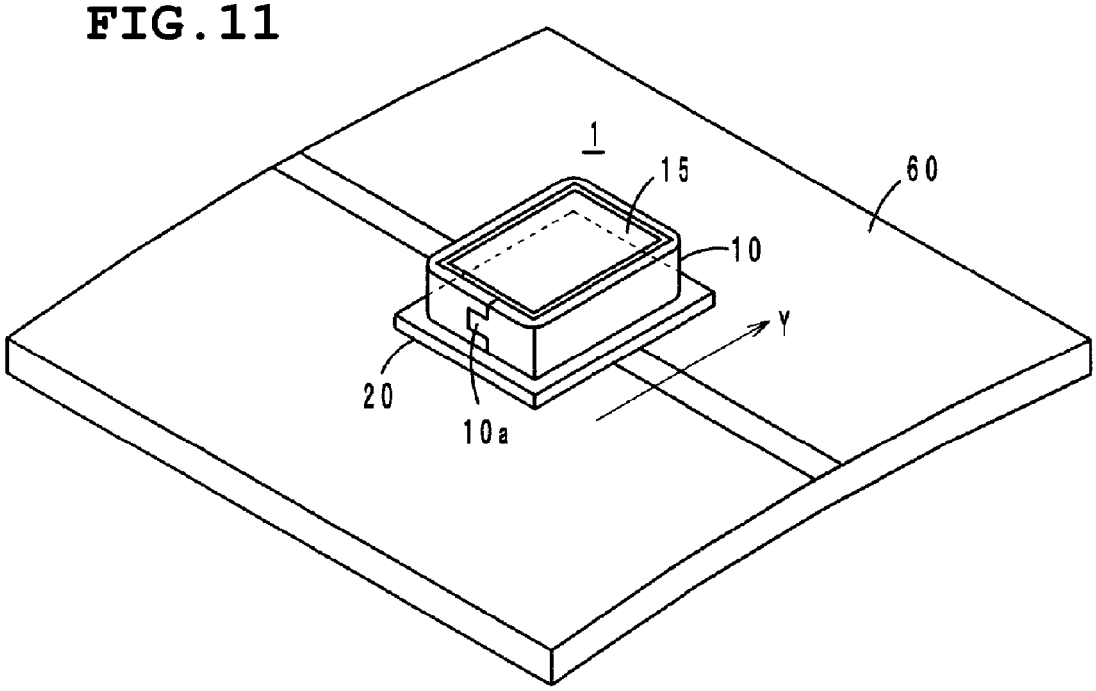
FIG. 11 is a perspective view showing a state where the mount board has warped in a longitudinal direction.

On the other hand, referring to FIG. 11, when the mount board 60 bends in the longitudinal direction Y of the circuit substrate 20, a relatively large bending force acts on the circuit substrate 20 since it has a large span in the longitudinal direction. However, because the longitudinal direction of the circuit substrate 20 and the longitudinal direction of the permanent magnets 41 and the ferrite 32 are substantially parallel to each other, the ferrite 32 and the permanent magnets 41 function as a beam for reinforcing the circuit substrate 20 in the longitudinal direction, thereby preventing the circuit substrate 20 from breaking. This enables the circuit substrate 20 to be made thinner than a conventional circuit substrate, thereby enabling for a compact and low profile structure of the isolator 1.

The yoke 10 has a substantially rectangular annular body that substantially corresponds to an outer peripheral area on the front surface of the circuit substrate 20 and is connected at a single joint 10*a*, whereby a favorable direct-current magnetic circuit is achieved. In particular, since the joint 10*a* is formed by crushing, a further favorable direct-current magnetic circuit is achieved.

Figure 12A:
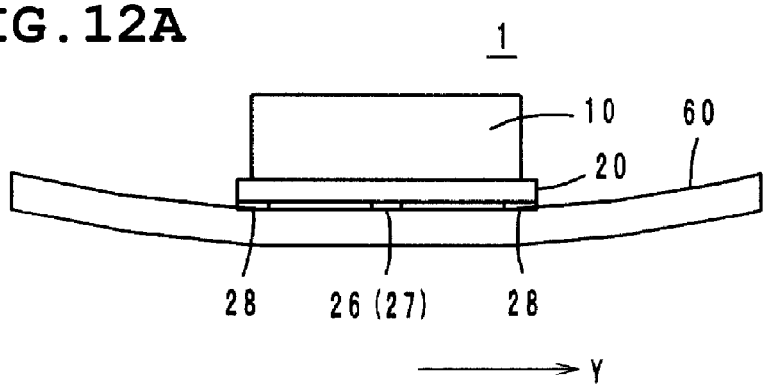
FIGS. 12A and 12B include front views showing a state where the mount board has warped in the longitudinal direction.
Figure 12B:
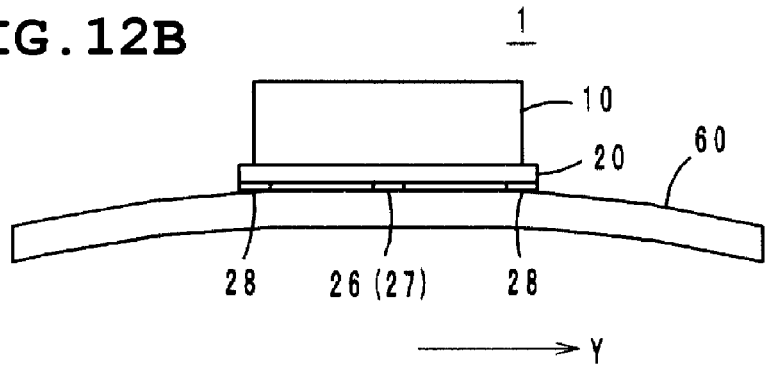

In addition, the joint 10*a* is located near one of the lateral edges of the circuit substrate 20, and as shown in FIGS. 12A and 12B, there are no joints in the longitudinal sidewalls of the yoke 10. Thus, the longitudinal sidewalls of the yoke 10 function as beams that resist against the bending force acting in the longitudinal direction of the circuit substrate 20 as well as reinforcing the circuit substrate 20. Consequently, the circuit substrate 20 is even more highly resistant against the bending force acting in the longitudinal direction Y.

Figure 13A:
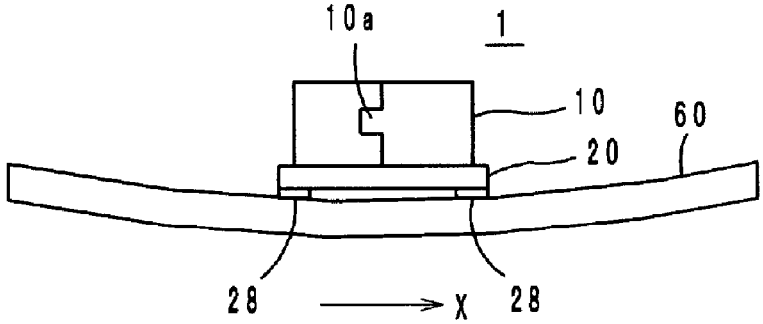
FIGS. 13A and 13B include side views showing a state where the mount board has warped in the lateral direction.
Figure 13B:
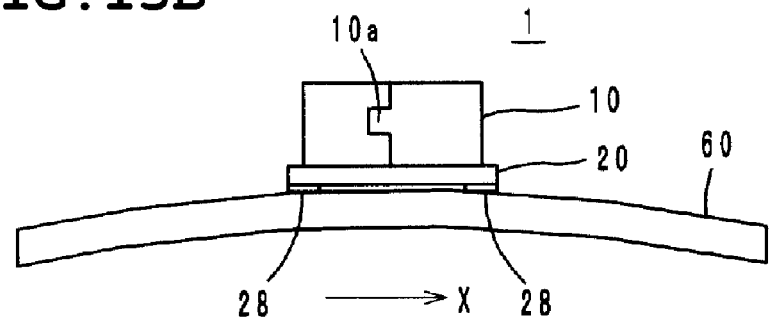

As shown in FIGS. 13A and 13B, the yoke 10 has the joint 10*a* at one of the lateral sidewalls thereof, and therefore, the strength of the lateral sidewalls of the yoke 10 is slightly weakened. However, even if the yoke 10 is slightly weakened in the lateral direction, the circuit substrate 20 itself has high strength in the lateral direction, whereby the circuit substrate 20 is prevented from breaking.

Furthermore, as shown in FIGS. 12A and 12B, three external-connection terminal electrodes 26 (27), 28, 28 are arranged along each of opposite longitudinal edges of the circuit substrate 20 on the back surface of the circuit substrate 20. When there are three of more external-connection terminal electrodes 26 (27), 28, 28 arranged along a longitudinal edge of the circuit substrate 20, one of the external-connection terminal electrodes will be bonded to the mount board 60 in substantially the central section along the longitudinal edge. For this reason, when the mount board 60 bends as a result of a bending force acting in the longitudinal direction Y, the bending force will have a large effect on the circuit substrate 20 with the central bonded section acting as a fulcrum. This may cause the circuit substrate 20 to more easily break. However, since the yoke 10 functions as a beam for reinforcing the circuit substrate 20 in the longitudinal direction Y, the circuit substrate 20 is prevented from breaking.

Figure 14A:
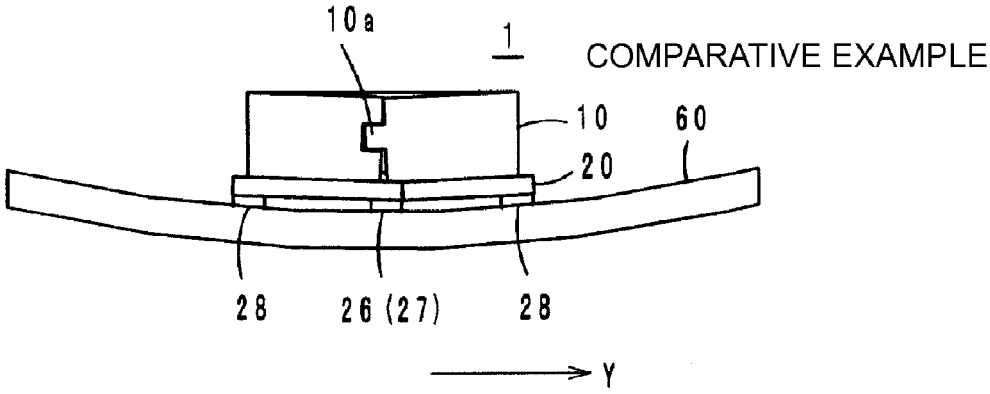
FIGS. 14A and 14B include front views showing a state where the mount board has warped in the longitudinal direction in a comparative example.
Figure 14B:
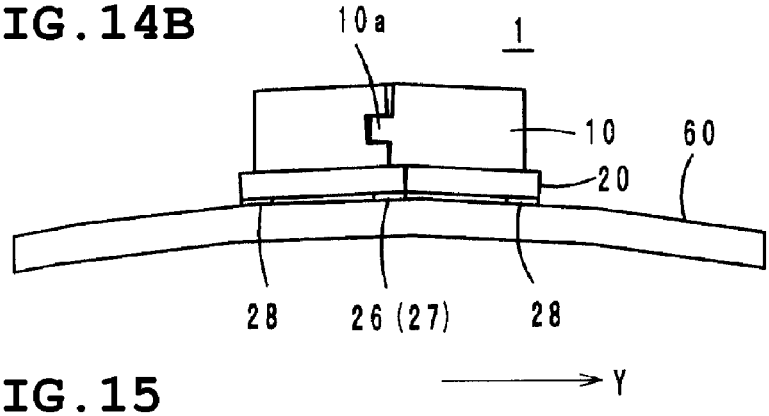

FIGS. 14A and 14B show an example where the joint 10*a* is supposedly provided at a longitudinal sidewall of the yoke 10. In this case, when a bending force acts on the circuit substrate 20 in the longitudinal direction Y, the longitudinal sidewall of the yoke 10 that is slightly weakened due to the joint 10*a* becomes deformed and thus is incapable of functioning as a beam. This will increase the possibility of breakage of the circuit substrate 20. Consequently, providing the joint 10*a* at a lateral sidewall of the yoke 10 is effective for preventing the circuit substrate 20 from breaking.

In other words, in the isolator 1, the ferrite 32 and the permanent magnets 41 are disposed vertically with respect to the circuit substrate 20 having rectangular surfaces, and the longitudinal sides of the ferrite 32 and the permanent magnets 41 are set parallel to the longitudinal edges of the circuit substrate 20. Thus, the ferrite 32 and the permanent magnets 41 have a reinforcing effect against a bending force acting in the longitudinal direction Y of the circuit substrate 20. In addition, since the yoke 10 having a substantially rectangular annular body also has its longitudinal sidewalls disposed substantially parallel to the longitudinal direction Y of the circuit substrate 20, the yoke 10 similarly has a reinforcing effect against a bending force acting in the longitudinal direction Y of the circuit substrate 20. Because the joint 10*a* of the yoke 10 is located nearer to a lateral edge of the circuit substrate 20, the strength reinforcing function for the longitudinal direction Y of the circuit substrate 20 is not impaired in any way. Although the circuit substrate 20 is weak against a bending force acting in the longitudinal direction Y due to the fact that three external-connection terminal electrodes 26 (27), 28, 28 arranged along each of the opposite longitudinal edges of the circuit substrate 20 are bonded to the lands on the mount board 60, the circuit substrate 20 is reinforced in the longitudinal direction by the ferrite 32, the permanent magnets 41, and the yoke 10, as described above. Accordingly, this further prevents the circuit substrate 20 from breaking.

With regard to the bonding relationship between the yoke 10 and the circuit substrate 20, the joint 10*a* of the yoke 10 is soldered to the terminal electrode 25*d* of the circuit substrate 20. In this case, the solder fills the gap 10*b* (see FIG. 8) provided in the joint 10*a* so that secure soldering is achieved.

Furthermore, the approximate midsection of each longitudinal sidewall of the yoke 10 is provided with a recess 10*c*. The recesses 10*c* are filled with an adhesive so that the longitudinal sidewalls of the yoke 10 are bonded to the circuit substrate 20. Together with the soldered lateral sidewall, this bonding of the longitudinal sidewalls to the circuit substrate 20 prevents the fixation strength from deteriorating. The use of an epoxy-type thermosetting adhesive having high thermo-stability as the adhesive prevents problems from occurring when the solder that fixes the lateral sidewall of the yoke 10 in position melts during reflow at the time of the mounting process. This enhances the reliability. In addition, the adhesive can be cured simultaneously with the solder by appropriately controlling the conditions, such as temperature and time.

Because the yoke 10 also functions as a ground electrode, undesired stray capacitances are generated when the capacitor electrodes included in the circuit substrate 20 and the yoke 10 are closely in contact with each other through the dielectric material of the circuit substrate 20. In addition, the capacitance values of the stray capacitances vary depending on the mounting position of the yoke 10 on the circuit substrate 20. This variation in the stray capacitance values causes variations in the electric properties of the isolator 1.

To prevent stray capacitances from being generated between the capacitor electrodes in the circuit substrate 20 and the yoke 10, it is necessary to place the capacitor electrodes a sufficient distance from the exterior of the annular yoke 10, i.e., in the interior of the annular yoke 10.

However, if the capacitor electrodes are to be placed within the yoke 10, the peripheral areas of the circuit substrate 20 cannot be used for the placement of the capacitor electrodes. This implies that the number of lamination layers for the capacitor electrodes needs to be increased to obtain a required capacity. Increasing the number of lamination layers leads to an increase in the thickness of the circuit substrate 20. Although this may achieve sufficient strength, the height of the isolator 1 is unfavorably increased. In addition, increasing the number of lamination layers may cause misalignment between the lamination layers, leading to variations in the capacitances of the capacitors and to variations in the electric properties.

In the isolator 1, the recesses 10*c* are provided in the lower surfaces of the longitudinal sidewalls of the yoke 10, and the air existing in the recesses 10*c* has a relative dielectric constant of 1. This reduces occurrences of undesired stray capacitances. Even if there are variations in the stray capacitance values, the variations in the electrical properties are reduced since the values themselves are small. In addition, the capacitor electrodes may be disposed in the peripheral areas of the circuit substrate 20, whereby the number of lamination layers for the capacitor electrodes are reduced. This reduces adverse effects resulting from misalignment between the lamination layers and reduces variations in the electrical properties. Moreover, this contributes also to a low-profile structure of the circuit substrate 20.

With each of the recesses 10*c* of the yoke 10 being filled with an adhesive, the adhesive has a relative dielectric constant of about 3 to about 4, which is greater than that of air, which is 1, but is less than that of a dielectric substrate, which is in a range of about 8 to about 100. Filling the recesses 10*c* with the adhesive provides an anchoring effect, thereby enhancing the reliability.

Referring to FIG. 5, in the isolator 1, the stray capacitances generated are indicated by C2', CP1', CP2', and CP3'. These stray capacitances are produced substantially in parallel to the capacitors C2, CP1, CP2, CP3. When the stray capacitance C2' changes, the center frequency of a reflection loss at the side of the output port P2 primarily changes. This results in a change in the center frequency of forward-direction transmission characteristics. When the stray capacitance CP1' or CP2' changes, the matching state of a reflection loss at the side of the input port P1 primarily changes. This results in deterioration of the matching state at the input side and causes a forward-direction insertion loss to increase. In addition, a change in the load impedance of a circuit at a stage prior to the isolator 1, such as a power amplifier, intensifies the distortion in an output waveform of the power amplifier or increases the current consumption. When the stray capacitance CP3' changes, the matching state of a reflection loss at the side of the output port P2 primarily changes. This results in deterioration of the matching state at the output side and causes a forward-direction insertion loss to increase.

The ferrite 32 and the pair of permanent magnets 41 are combined with each other via the adhesive sheet layers 42. Thus, the isolator 1 is mechanically stable and has a rigid structure that is prevented from being deformed or breaking in response to vibration or shock. This isolator 1 is suitable for a portable communication device. Instead of using the adhesive sheet layers 42 for combining the ferrite 32 and the permanent magnets 41, other various alternatives may be applied. One alternative example is to apply an adhesive agent.

Since the center electrodes 35, 36 are formed as conducting layers on the principal surfaces 32*a*, 32*b* of the ferrite 32, these electrodes are formed into shape with high precision, thereby allowing for mass production of the isolators 1 having uniform electrical properties. In addition, by using a layer of sintered glass powder for the insulating layer between the center electrodes 35 and 36, the principal surfaces 32*a*, 32*b* of the ferrite 32 have a high degree of flatness as compared to a case in which the center electrodes are formed of metal sheets. As a result, the ferrite 32 and the pair of permanent magnets 41 can be combined with a high degree of parallelism with respect to the positional relationship therebetween.

Figure 15:
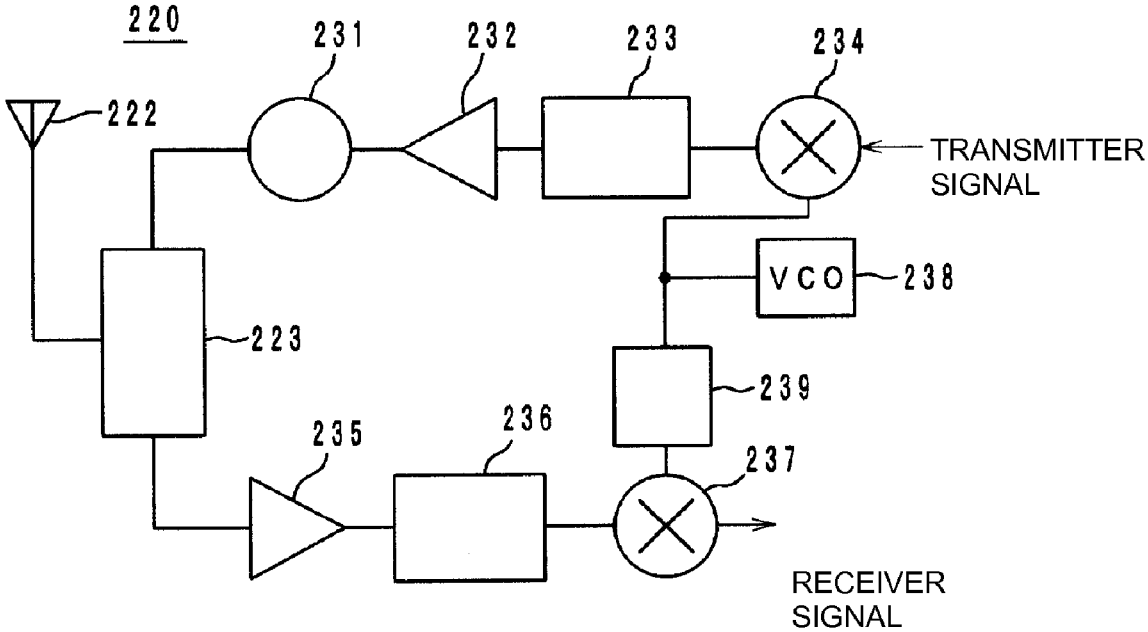
FIG. 15 is a block diagram of a communication device according to a preferred embodiment of the present invention.

A portable telephone will now be described as an example of a communication device according to a preferred embodiment of the present invention. FIG. 15 is an electric-circuit block diagram of an RF portion of a portable telephone 220. In FIG. 15, reference numeral 222 denotes an antenna element, reference numeral 223 denotes a duplexer, reference numeral 231 denotes a transmitting-side isolator, reference numeral 232 denotes a transmitting-side amplifier, reference numeral 233 denotes a transmitting-side interstage bandpass filter, reference numeral 234 denotes a transmitting-side mixer, reference numeral 235 denotes a receiving-side amplifier, reference numeral 236 denotes a receiving-side interstage bandpass filter, reference numeral 237 denotes a receiving-side mixer, reference numeral 238 denotes a voltage-controlled oscillator (VCO), and reference numeral 239 denotes a local bandpass filter.

The two-port isolator 1 described above can be used as the transmitting-side isolator 231. The installation of the isolator 1 provides favorable electrical properties and contributes to a compact and low-profile structure.

The non-reciprocal circuit element and the communication device according to the present invention are not limited to the preferred embodiments described above, and various modifications are permissible within the scope and spirit of the invention.

For example, by inverting the N-pole and the S-pole of the permanent magnets 41, the input port P1 and the output port P2 can be switched. Furthermore, although the matching and impedance-adjusting circuit components are all included in the circuit substrate in the above preferred embodiments, the circuit substrate may alternatively have chip-type inductors or capacitors externally attached thereto.

Accordingly, the present invention provides a non-reciprocal circuit element, such as an isolator or a circulator, for use in microwave bands. In particular, the present invention is advantageous in that a circuit substrate of the non-reciprocal circuit element is prevented from being damaged as a result of bending of a mount board, and that high reliability and a low-profile structure are achieved.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A non-reciprocal circuit element comprising:

a permanent magnet;

a ferrite that receives a direct-current magnetic field from the permanent magnet;

a plurality of center electrodes disposed on the ferrite;

a circuit substrate having terminal electrodes on front and back surfaces thereof; and a yoke surrounding the permanent magnet and the ferrite on the circuit substrate; wherein the center electrodes on the ferrite include conductive film;

the surfaces of the circuit substrate is substantially rectangular;

the terminal electrodes include a terminal electrode provided on the front surface and an external-connection terminal electrode provided on the back surface;

the permanent magnet and the ferrite are disposed on the front surface of the circuit substrate, the permanent magnet and the ferrite having principal surfaces, respectively, that face each other and are substantially perpendicular to the front surface of the circuit substrate, and having longitudinal sides that are substantially parallel to longitudinal edges of the circuit substrate; and a surface of the ferrite that faces the circuit substrate is provided with a connector electrode, the connector electrode being electrically and mechanically connected to the terminal electrode provided on the front surface of the circuit substrate.

2. The non-reciprocal circuit element according to claim 1, wherein the center electrodes comprise a first center electrode and a second center electrode that are insulated from each other and that intersect each other, the first center electrode having one end electrically connected to a first input-output port and the other end electrically connected to a second input-output port, the second center electrode having one end electrically connected to the second input-output port and the other end electrically connected to a third ground port.

3. The non-reciprocal circuit element according to claim 1, wherein the yoke is provided with recesses in the longitudinal sidewalls of the yoke that face the circuit substrate.

4. A communication device comprising the non-reciprocal circuit element according to claim 1.

5. The non-reciprocal circuit element according to claim 1, wherein the longitudinal sidewalls of the yoke are bonded to the circuit substrate with an adhesive.

6. The non-reciprocal circuit element according to claim 5, wherein the adhesive is an epoxy-type thermosetting adhesive.

7. The non-reciprocal circuit element according to claim 1, wherein the yoke has a substantially rectangular annular body that substantially corresponds to an outer peripheral area on the front surface of the circuit substrate, the yoke having longitudinal sidewalls that are disposed substantially parallel to the longitudinal edges of the circuit substrate, the yoke having a joint for connecting into the annular shape, the joint being provided in its sidewall corresponding to a lateral edge of the circuit substrate.

8. The non-reciprocal circuit element according to claim 7, wherein the joint is formed by crushing.

9. The non-reciprocal circuit element according to claim 7, wherein the external-connection terminal electrodes provided on the back surface of the circuit substrate include at least three external-connection terminal electrodes along each of the opposite longitudinal edges of the circuit substrate.

10. The non-reciprocal circuit element according to claim 7, wherein the joint provided in the yoke is soldered to the terminal electrode of the circuit substrate.

* * * * *